United States Patent [19]

Andersson et al.

[11] 4,045,099

[45] Aug. 30, 1977

[54] ROTOR FOR A TURBO-MACHINE

[75] Inventors: Lars Andersson, Hudiksvall; Johnny Rehn, Malmo; Ragnar Torstenfelt, Finspong, all of Sweden

[73] Assignee: Stal-Laval Turbin AB, Finspong, Sweden

[21] Appl. No.: 659,293

[22] Filed: Feb. 19, 1976

[30] Foreign Application Priority Data

Feb. 21, 1975 Sweden ..... 7501949

[51] Int. Cl.[2] ..... F16C 32/00

[52] U.S. Cl. ..... 308/36; 308/DIG. 15

[58] Field of Search ..... 308/DIG. 15, 36, 8, 308/37, 237 R

[56] References Cited

U.S. PATENT DOCUMENTS 3,043,636 7/1962 MacInnes et al. ..... 308/DIG. 15

3,394,875 7/1968 Hasa et al. ..... 308/DIG. 15

*Primary Examiner*—Richard A. Bertsch

*Attorney, Agent, or Firm*—Pollock, Vande Sande & Priddy

[57] ABSTRACT

A rotor of self-supporting type for a turbo-machine. The rotor comprises a plurality of axially spaced discs which are interleaved with spacing rings and with the assembled combination of discs and rings held together by through bolts. Each spacing ring is provided on each opposed face with an annular shoulder which mates with a cooperating annular shoulder on an opposing face of an adjacent disc so as to prevent relative radial movement among the assembled discs and rings. A portion of each ring extends radially inwardly of its annular shoulders and is provided with a thickness in the axial direction which is less than the spacing between the opposing surfaces of the adjoining discs.

3 Claims, 3 Drawing Figures

III - III

ROTOR FOR A TURBO-MACHINE

BACKGROUND OF THE INVENTION

The present invention relates to a rotor of the self-supporting type for a turbo-machine. The rotor has no main shaft therethrough, but instead comprises a plurality of blade-carrying discs which are held together by axial bolts and are mutually guided by spacing rings only. This construction is above all intended for multi-stage machines, the discs in the rotor described being provided with central holes which leave free space for a through shaft of another stage in the turbomachine.

In turbo-machines of this kind, great demands are made on the guiding of the discs by the spacing rings, especially in large machines where the dead weight of the rings causes great stresses in the rings because of the rotational forces. In order to limit the elongation in the rings and thus avoid play between these and the circular edges of the discs, the rings must have a sufficient cross-sectional area. However, there must be taken into consideration that an increase in this cross-sectional area will also increase the dead weight of the rings and therefore the rotational forces.

SUMMARY OF THE INVENTION

The problem referred to above is solved by providing on both of the opposed faces of each spacing ring an annular shoulder which mates with a cooperating annular shoulder on an opposing face of an adjacent disc so as to prevent relative radial movement among the assembled discs and spacing rings. Moreover, a portion of each annular ring extends radially inwardly of its annular shoulders and is provided with a thickness in the axial direction which is less than the spacing between the opposed surfaces of the adjoining discs.

BRIEF DESCRIPTION OF THE DRAWINGS

The invention will be described in more detail with reference to the accompanying drawing, in which:

FIG. 1 schematically shows a turbo-machine of the type referred to;

DETAILED DESCRIPTION OF THE PREFERRED EMBODIMENT

Figure 1:
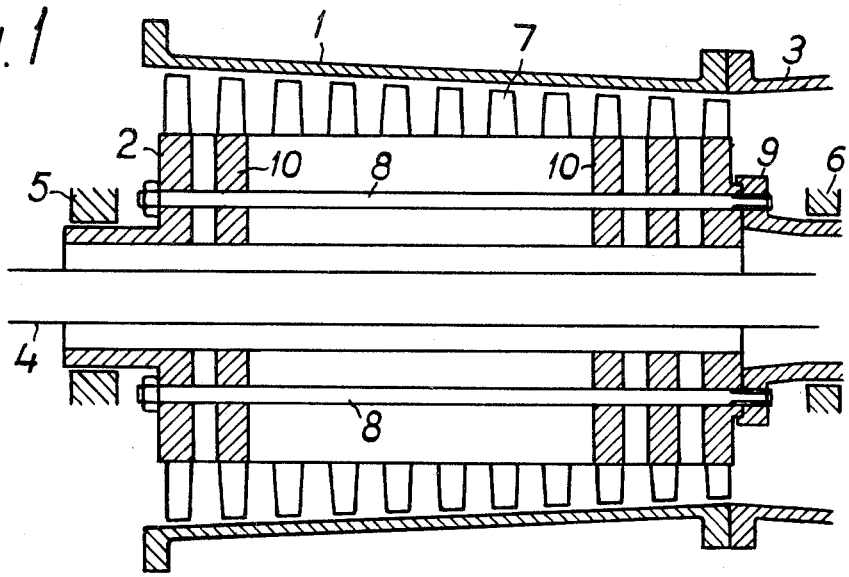

FIG. 1 shows an axial section of a turbo-machine comprising stator 1 and rotor 2 and constituting a part of a multi-stage machine which may, for example, comprise the high-pressure compressor stage of a gas turbine. Only the outer casing of stator 1 is shown, and this is connected to another part 3 of the machine unit by means of mating flanges. The rotor 2 is hollow so as to provide free space for a through shaft 4 of another stage of the unit. Bearings 5 and 6 for the rotor are shown diagrammatically.

As mentioned, the rotor 2 is self-supporting without a through shaft and is formed of discs 10 with blades 7 and spacing rings between the discs. The rotor is held together by bolts 8 which may be fastened to an end flange 9 or may be clamped directly against an outer disc of the rotor.

Figure 2:
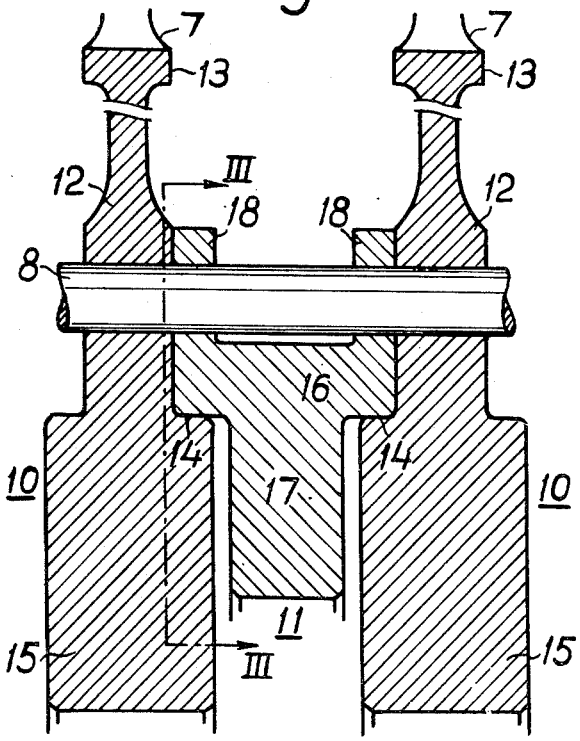
FIG. 2 shows in more detail how discs and spacing rings are put together.

Discs 10 and spacing rings 11 are shown in more detail in FIG. 2 which shows, on an enlarged scale, a small portion of FIG. 1. Each disc is provided with a thicker, central part 15 which forms a kind of hub for the disc. The part 12 which extends radially outwardly of this hub portion 15 is thinner and becomes even thinner towards its outer edge where the disc is provided with a thicker edge 13 for attachment of the blades 7.

The discs are held together by bolts 9 and are spaced the proper distance from each other by means of spacing rings 11. Each spacing ring 11 has a central section 16 with a rectangular cross-section, whose thickness in the axial direction of the rotor defines the distance between the discs. The inner diameter of the portion 16 has a close fit to the diameter of the circular outer edge 14 of the hub 15 so that the mutual radial positions of the discs are constantly maintained.

Especially in large machines and at high speeds, the dead weight of the spacing rings causes considerable centrifugal forces and thus tensile stresses in the rings which tends to elongate and distend the rings. The resultant risk of mutual, radial displacement of the discs may be prevented by providing a tighter fit of the central portion 16 of each ring relative to the edge 14 of the hub 15; however, this makes it more difficult to assemble the discs and rings and also involves the risk that the discs and rings are not compressed exactly in the axial direction. As an alternative, it might be considered that an increase in the diameter of the part 16 would alleviate the problem; however, this also is not a desirable solution to the problem since the stress in the added material will be as great as, and will even, in fact, be greater than in a ring not so modified because of the greater radius of the added material.

According to the invention, the space between the disc hub 15 is instead utilized to provide a reinforcing portion 17, and because this portion 17 has a smaller radius than the part 16, the centrifugal forces acting thereon and thus also the internal stresses in the ring will be smaller. As a result, a greater part of the strength of the ring can be utilized to provide the desired contact force between the ring part 16 and the edge 14 of the disc hub 15.

Figure 3:
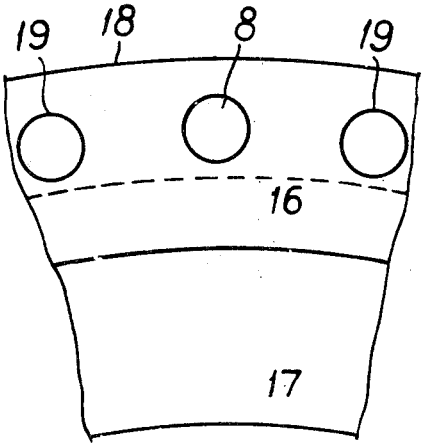
FIG. 3 shows a detail of a spacing ring.

To prevent relative rotation of the parts constituting the rotor, the spacing rings 11 must be fixed in relation to the bolts 8, and this is accomplished with the aid of flanges 18 on the spacing rings which are provided with bores for receiving through bolts 8. By constructing the rings with opposed flanges 18, and thereby effectively removing the material which would otherwise be present between flanges 18, the centrifugal forces acting on each disc are further reduced in an advantageous manner since such material would, in any event, contribute little to the strengthening of the rings. The rings 16 may, in addition, be suitably provided with further bores 19 between the bolts 8 as shown in FIG. 3 in order to reduce further the mass of the ring adjacent its periphery.

What is claimed is:

1. In a rotor for a turbine machine of the axial flow type having a plurality of axially spaced discs for mounting turbine blades and interleaved spacing rings all held in abutting relationship for rotation as a unit by a plurality of circularly disposed through bolts and with each face of each of said spacing rings defining thereon an annular shoulder which mates with a cooperating annular shoulder on an opposing face of an adjacent disc to prevent relative radial movement among said assembled discs and spacing rings, the improvement comprising:

a portion of each said spacing ring extending radially inwardly of said annular shoulder and having a thickness in the axial direction less than the spacing between the opposing faces of the adjacent discs to thereby increase the strength of each said spacing ring but with a minimal increase on the stresses thereon resulting from high speed rotation.

2. The improvement of claim 1 wherein each said spacing ring defines on its outer periphery a pair of axially spaced flanges defining apertures therein for receiving the through bolts.

3. The improvement of claim 2 wherein each said spacing ring further defines in its axially spaced flanges a plurality of apertures which are respectively each disposed between a successive pair of bolt-receiving apertures.

* * * * *